US005590700A

United States Patent [19]

Brand

[11] Patent Number: 5,590,700

[45] Date of Patent: Jan. 7, 1997

[54] VACUUM FLITCH TABLE WITH SELF-CLEANING VACUUM VALVE

[75] Inventor: Robert D. Brand, Lawrence, Ind.

[73] Assignee: Capital Machine Co., Inc., Indianapolis, Ind.

[21] Appl. No.: 559,296

[22] Filed: Nov. 15, 1995

[51] Int. Cl.[6] ..... B27L 5/06

[52] U.S. Cl. ..... 144/178; 144/278.3; 144/369; 83/452; 83/461; 248/362; 269/21

[58] Field of Search ..... 83/451, 452, 461; 137/533.15; 144/162.1, 178, 278.1, 278.3; 248/362, 363; 251/213; 269/21

[56] References Cited

U.S. PATENT DOCUMENTS

| | | | |
|---|---|---|---|
| 793,306 | 6/1905 | Koss . | |
| 2,576,520 | 11/1951 | Koss | 144/278 |
| 2,676,627 | 4/1954 | McFall | 144/178 |
| 3,441,069 | 4/1969 | Koss | 144/369 |
| 3,654,973 | 4/1972 | Koss | 144/178 |
| 3,680,612 | 8/1972 | Hale | 144/178 |
| 3,808,925 | 5/1974 | Hards | 83/346 |
| 3,905,408 | 9/1975 | Hale | 144/178 |
| 4,068,693 | 1/1978 | Cremona | 144/178 |
| 4,069,850 | 1/1978 | Cremona | 144/178 |
| 4,392,519 | 7/1983 | Calvert | 144/212 |
| 4,503,896 | 3/1985 | Brand | 144/369 |
| 4,587,616 | 5/1986 | Weil | 364/475 |
| 4,601,317 | 7/1986 | Brand | 144/178 |
| 4,683,926 | 8/1987 | Weil | 144/178 |
| 5,101,874 | 4/1992 | Weil | 144/209 |
| 5,143,129 | 9/1992 | Toivio | 144/211 |
| 5,150,746 | 9/1992 | Weil | 144/209 |
| 5,333,658 | 8/1994 | Albion et al. | 144/213 |
| 5,385,184 | 1/1995 | Mellor | 144/178 |

FOREIGN PATENT DOCUMENTS

0627285A2 12/1994 European Pat. Off. .

*Primary Examiner*—W. Donald Bray
*Attorney, Agent, or Firm*—Brinks Hofer Gilson & Lione

[57] ABSTRACT

A vacuum valve includes a valve body with a cylindrical sidewall having a vacuum inlet coupled to a vacuum source and a vacuum outlet. A piston is disposed within the valve body for movement between an open position and a closed position and provides a vacuum port that extends between the vacuum inlet and the vacuum outlet when the piston is in the open position. The valve also includes means for cooperating with a vacuum source to remove material from the vacuum valve as the piston moves between the open and closed positions. The vacuum port of the piston includes a reduced diameter portion that provides a passageway for vacuum and debris. A sharp edge, preferably an annular knife edge, circumferentially surrounds the piston adjacent, and extending into, the reduced diameter portion. The annular knife edge is oriented to provide a cutting stroke during movement of the piston from the open position to the closed position. As the piston moves from the open position to the closed position, the annular knife cuts any debris remaining in the vacuum inlet or outlet and retains the debris in the reduced diameter portion until the piston moves back to the open position, whereupon the vacuum from the vacuum source sucks the debris out of the valve.

19 Claims, 5 Drawing Sheets

VACUUM FLITCH TABLE WITH SELF-CLEANING VACUUM VALVE

BACKGROUND OF THE INVENTION

The present invention relates to vacuum flitch tables in general and more particularly, the invention relates to self-cleaning vacuum valves for flitch tables that include a cutting edge for cutting debris caught in the valve.

In the veneer slicing industry, a flitch is carried on a flitch table for slicing. The flitch is held in place on the flitch table by a set of dogs and, typically, the table moves the flitch in a reciprocating motion past a slicing knife which slices the veneer from the flitch. Since the dogs extend upwardly from the flitch table as much as ¾ inch or one inch, a substantial thickness of the heart of the flitch unavailable for slicing. Unfortunately, the best veneer comes from the heart of the flitch. Thus, the loss of ¾ inch of a flitch to slicing represents a major loss of productivity.

Vacuum flitch tables have been proposed to overcome the problem by eliminating the need for the dogs. For example, U.S. Pat. No. 3,905,408 to Hale discloses a vacuum flitch table that includes a vacuum cell plate that incorporates a plurality of vacuum cells. Each vacuum cell is equipped with a check valve to open the cell to a vacuum source. When a flitch is placed on the flitch table, the flitch seals the vacuum cell and the check valve opens to admit vacuum to the cell and hold the flitch in place.

Unfortunately, conventional vacuum flitch tables suffer from a serious disadvantage in that the valves tend to get clogged up by debris from the flitch, such as dirt and splinters. One attempt to overcome the problem of clogged valves is disclosed in U.S. Pat. No. 5,385,184 to Mellor. The '184 patent discloses a vacuum flitch table that incorporates a ball valve to open each cell to the vacuum source and positions a screen between the flitch and the ball valve to keep the valve from clogging up with debris. However, the problem was not completely solved because the debris collection point was merely moved from the valve to the screen. The screen collects the debris and eventually clogs up. When the screen gets clogged up, an operator must unclog the screens, typically by actuating a blow-back system to blow the debris out of the screen by compressed air. Thus, such prior art systems involve lost worker productivity to unclog the screens and further requires a complicated and expensive blow-back system.

SUMMARY OF THE INVENTION

The present invention overcomes the disadvantages of the conventional vacuum flitch tables by providing a self-cleaning vacuum valve that resists clogging and eliminates the need for a blow-back system. The vacuum valve of the present invention cuts and eliminates debris caught in the valve each time the valve moves between an open position and a closed position.

The vacuum valve of the present invention includes a valve body with a cylindrical sidewall having a vacuum inlet coupled to a vacuum source and a vacuum outlet. A piston is disposed within the valve body for movement between an open position and a closed position and provides a vacuum port that extends between the vacuum inlet and the vacuum outlet when the piston is in the open position. Actuating means is coupled to the piston to move the piston between the open and closed positions. The valve also includes means for cooperating with a vacuum source to remove material from the vacuum valve as the piston moves between the open and closed positions.

The port means of the piston includes a reduced diameter portion that provides a passageway for vacuum and debris. The cooperating means is a sharp edge, preferably an annular knife edge, circumferentially surrounding the piston adjacent, and extending into, the reduced diameter portion. The annular knife edge is oriented to provide a cutting stroke during movement of the piston from the open position to the closed position. As the piston moves from the open position to the closed position, the annular knife cuts any debris remaining in the vacuum inlet or outlet and retains the debris in the reduced diameter portion until the piston moves back to the open position, whereupon the vacuum from the vacuum source sucks the debris out of the valve.

The simplicity of the present valve provides a reliable valve that is economical to manufacture and highly resistive to clogging. Moreover, the valve can be manufactured in relatively large sizes to provide larger vacuum ports extending therethrough to enhance the self-cleaning aspect of the invention.

Additional features and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

Figure 1:
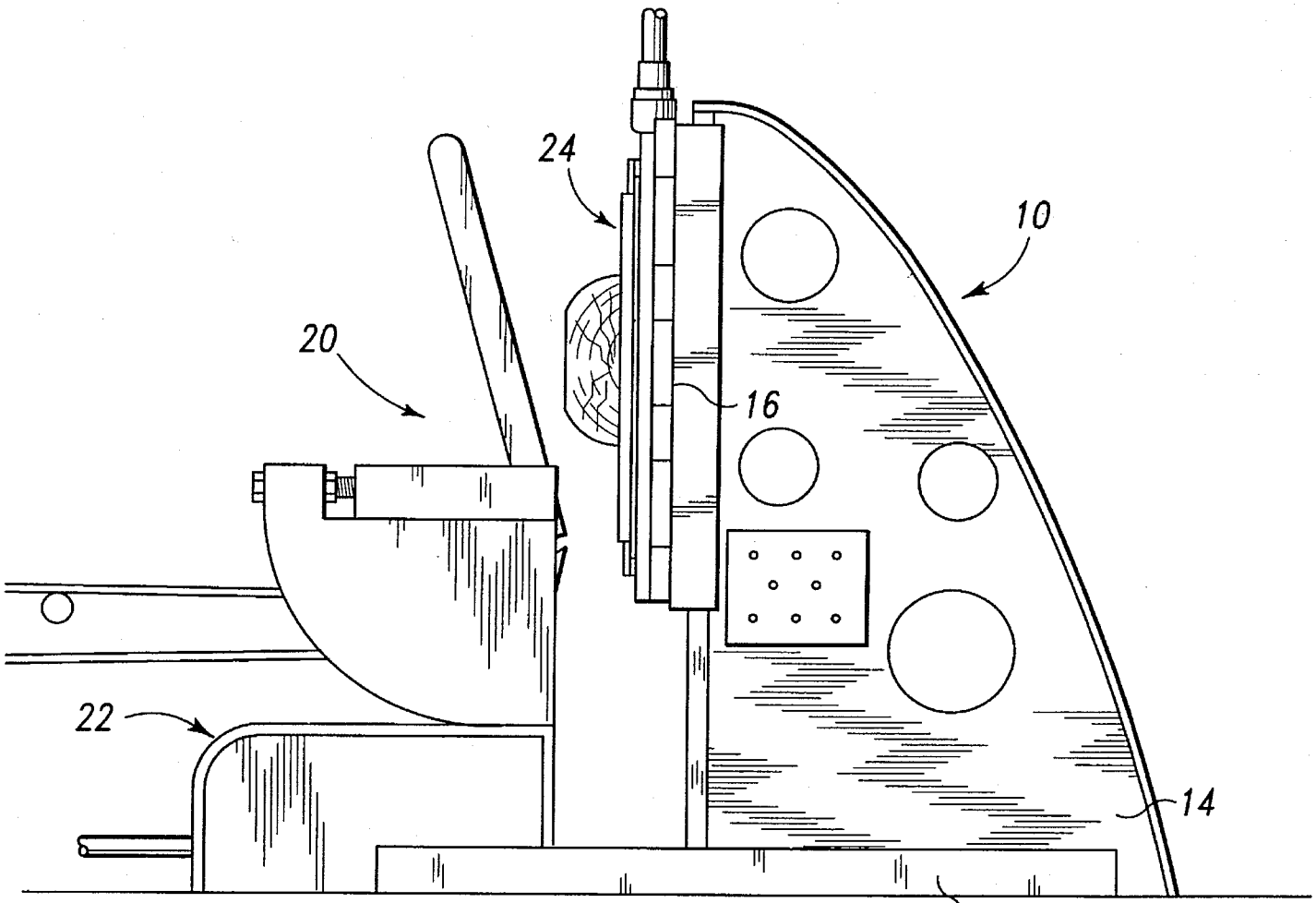
FIG. 1 is a diagrammatic drawing of a veneer-slicer for use with the present invention.
Figure 2:
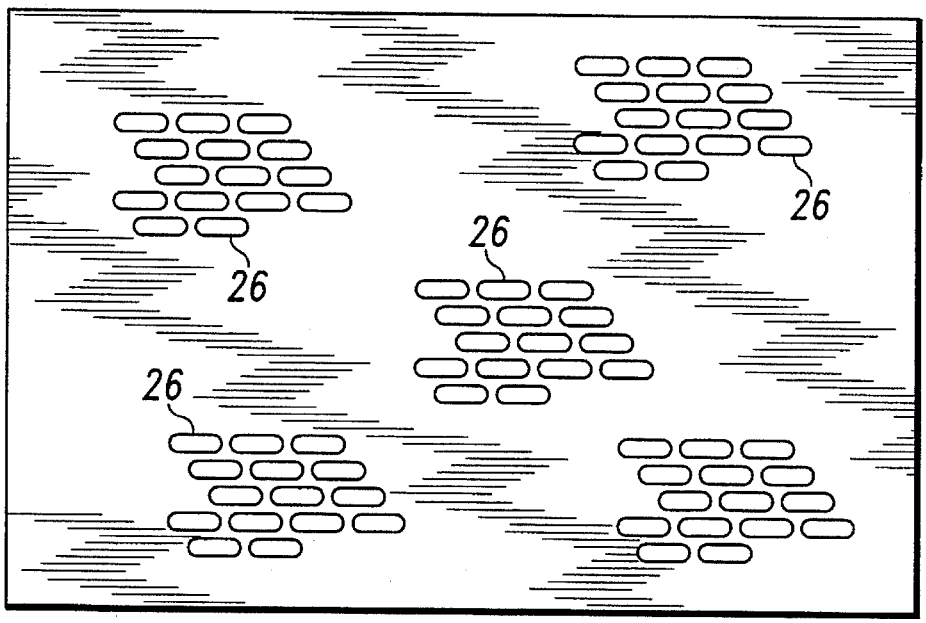
FIG. 2 is a diagrammatic view of a vacuum cell plate having a plurality of vacuum cell areas.

FIG. 1 illustrates a typical veneer-slicing system incorporating a presently preferred embodiment of the invention. The system comprises a veneer-slicing machine 10 that includes a base 12, a flitch table support 14, and a flitch table 16. A pressure plate and cutting blade assembly 20 is coupled to a carriage 22 which moves the pressure plate and cutting blade assembly 20 between a retracted position and a slicing position. The flitch table 16 includes a cell plate 24 that further includes a plurality of conventional vacuum cell areas 26, as illustrated in FIG. 2. The combined area of the vacuum cell areas 26 should cover a substantial portion of the cell plate surface area, but the actual design, size, and placement of the cell areas 26 do not a form a part of this invention.

Figure 3:
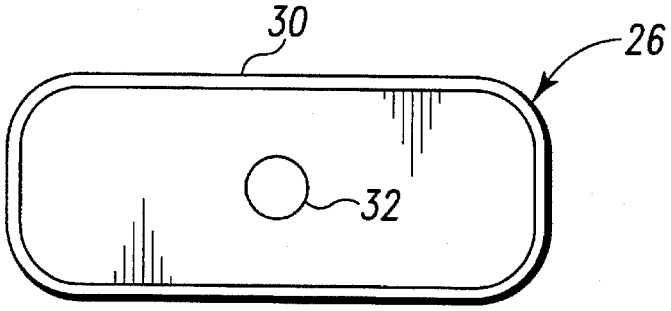
FIG. 3 is an enlarged top view of an individual vacuum cell.
Figure 7:
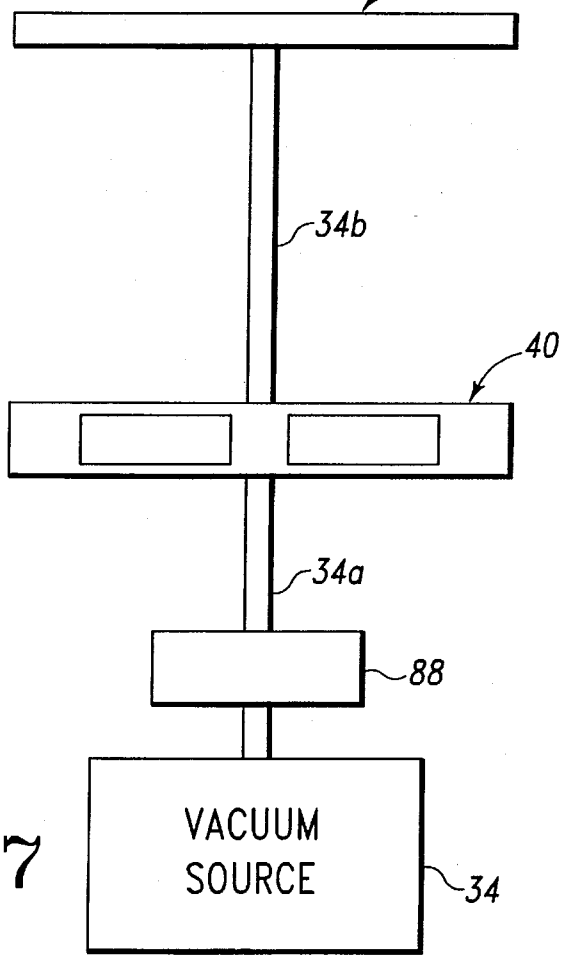
FIG. 7 is a schematic representation of the vacuum connection of the vacuum cell area with the vacuum source through the vacuum valve of the present invention.

As illustrated in FIG. 3, each vacuum cell area 26 includes a peripheral seal 30 for sealing contact with a flitch carried on the flitch table 16 and a vacuum port 32 in fluid communication with a vacuum source 34 (FIG. 7). As shown in FIG. 7, the vacuum CELL 26 is connected with the vacuum source 34 through a self-cleaning vacuum valve 40 of the present invention.

Figure 4:
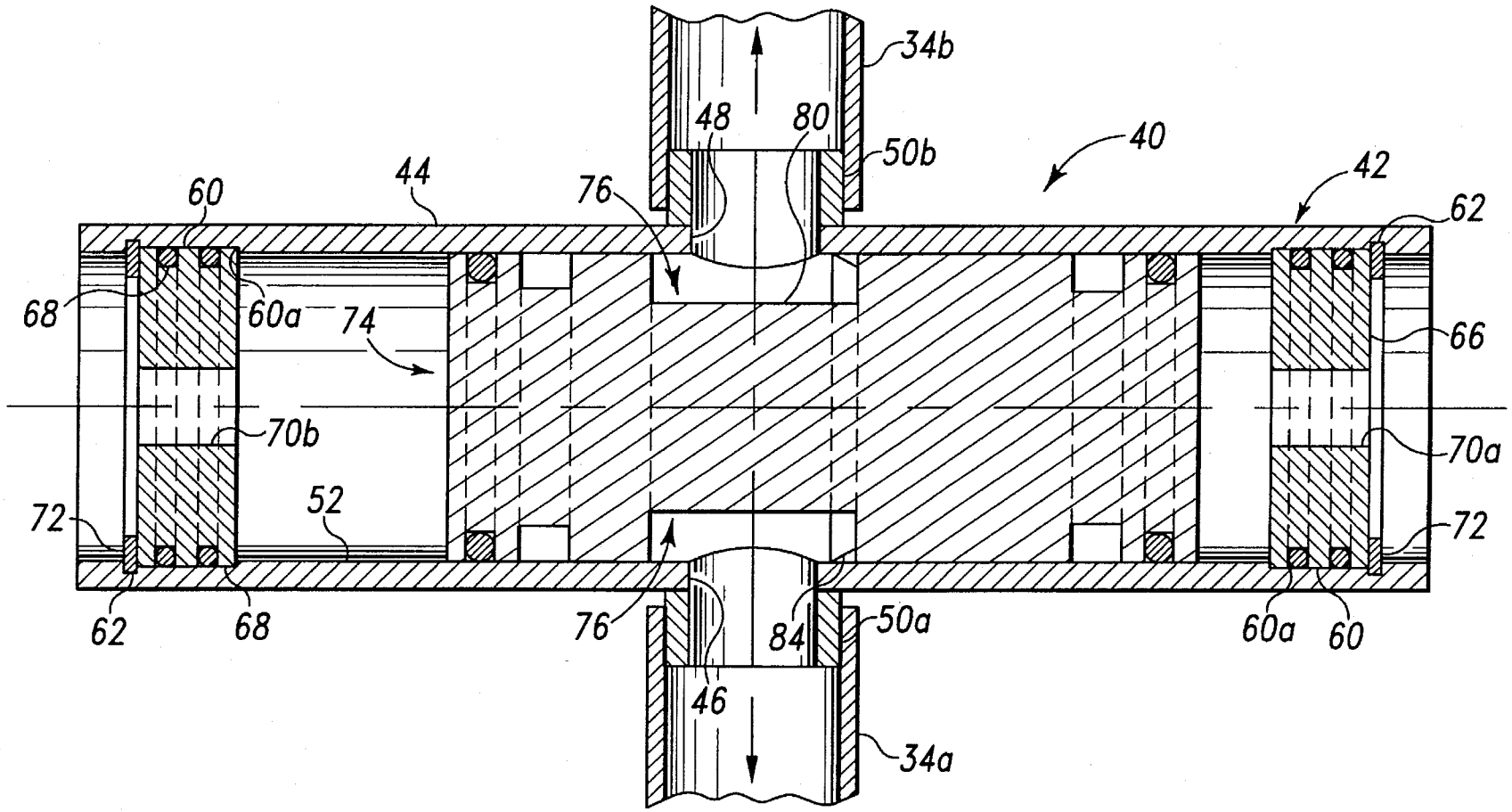
FIG. 4 is a section view taken along the longitudinal axis of a valve and through the vacuum inlet and outlet ports showing the valve in the open position to transmit vacuum from a vacuum source to vacuum cell area.
Figure 5:
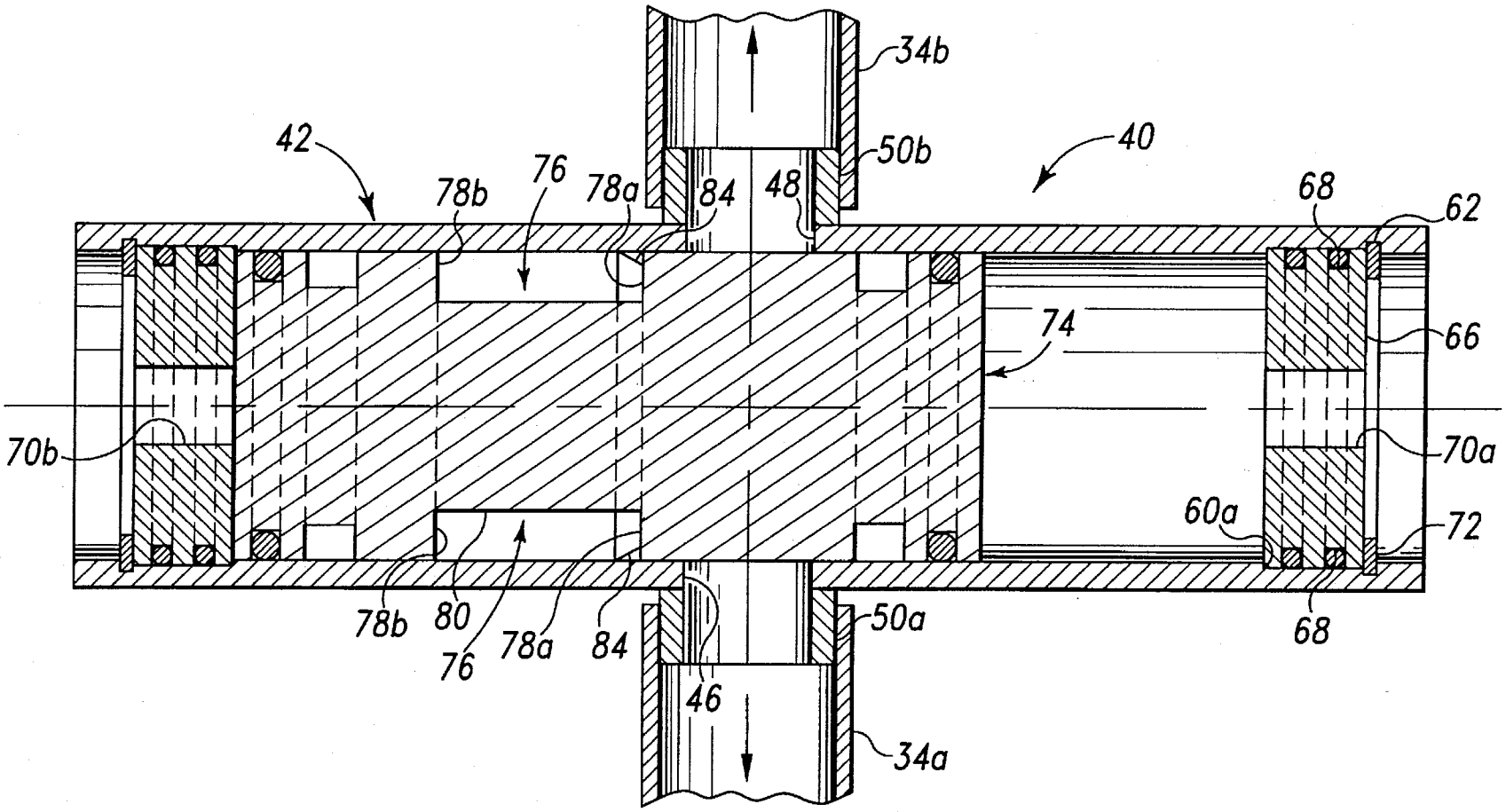
FIG. 5 is a section view similar to FIG. 4 with the valve in the closed position to shut off vacuum to the vacuum cell area.
Figure 6:
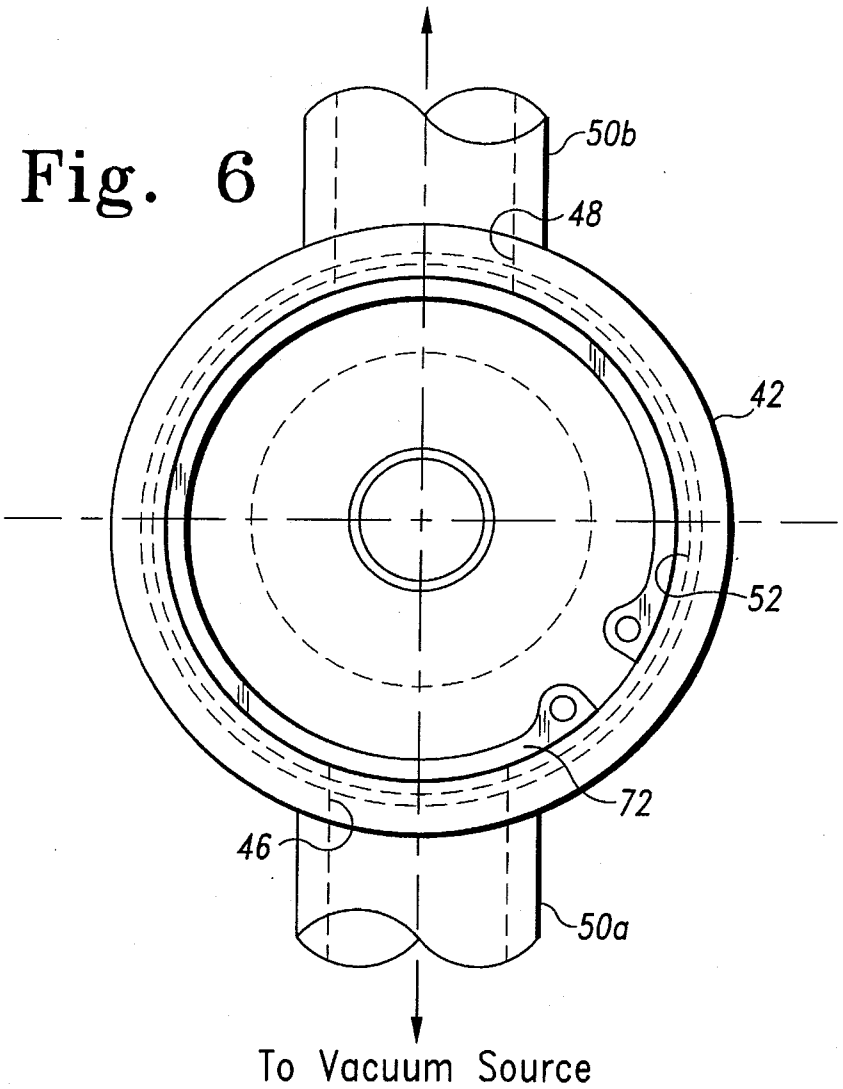
FIG. 6 is an end view of the valve of FIG. 4.

A self-cleaning valve 40 according to the present invention, shown in FIGS. 4–6, includes a valve body 42 having cylindrical sidewall 44 having a vacuum inlet aperture 46 and a vacuum outlet aperture 48. An adapter 50*a*, 50*b* is attached to the cylindrical sidewall 44 at the vacuum inlet and outlet apertures 46, 48, respectively, to provide an attachment point for vacuum lines connecting a vacuum source 34 to the vacuum inlet aperture 46 and connecting the vacuum outlet aperture 48 to a vacuum cell area 26.

The inner surface 52 of the cylindrical sidewall 44 includes an end plug-receiving portion 60, having an increased inner radius, formed at each end of the valve body 42. The end plug-receiving portion 60 includes a shoulder 60*a* defining an inner limit of the plug-receiving portion 60. A snap ring-receiving groove 62 is formed in each end plug-receiving portion 60.

An end plug 66 is disposed in each end plug-receiving portion 60. Each end plug 66 includes a plurality of O-ring receiving grooves 68 and a central aperture 70*a*, 70*b* extending therethrough. In preferred embodiments, the apertures 70*a*, 70*b* are threaded to receive a pressure line from a source of pneumatic or hydraulic pressure. The end plugs 66 are inserted into the cylindrical sidewall 44 so as to abut the shoulder 60*a* and are held in position by a snap ring 72 positioned in the snap ring-receiving groove 62. Thus, the shoulders 60*a* and the snap rings 72 cooperate to retain the end plugs 66 in place.

A piston 74 is disposed in the valve body 42 for axial movement therein between the end plugs 66. The radius of the piston 74 is substantially equal to the radius of the inner surface 52 of the cylindrical sidewall 44. The piston 74 includes a reduced diameter portion 76 defined by a pair of opposing radial sidewalls 78*a*, 78*b* and a cylindrical surface 80 extending therebetween. A sharp edge can be formed at the outer circumference of the radial sidewalls 70*a*, 70*b*. For example, the piston 74 also includes an annular knife edge 84 extending circumferentially around the piston 74 and projecting parallel to the longitudinal axis of the piston from radial sidewall 78*a* partially into the reduced diameter portion 76. The radial sidewalls 78*a*, 78*b* have sufficient depth that debris removed by the annular knife edge 84 will be accepted in the reduced diameter portion 76.

In operation, pressure (air or hydraulic) is applied to the aperture 70*a* to move the piston 84 from the open position illustrated in FIG. 4 to the closed position illustrated in FIG. 5. As the pressure is applied to the aperture 70*a*, air (or hydraulic fluid) is allowed to vent through aperture 70*b* and the piston 74 moves to the left. As the piston 74 moves to the left, the reduced diameter portion 76 is moved out of alignment with the vacuum inlet and outlet 46, 48, thereby closing the valve 40 and shutting off vacuum from the vacuum cell area 26. At the same time, the annular knife edge 84 passes the vacuum inlet and outlet 46, 48 and cooperates with the cylindrical sidewall 44 in a scissors action to cut any debris remaining in the vacuum inlet or outlet 46, 48. Of course, the annular knife edge 84 can be serrated to enhance the cutting ability of the edge 84.

When the valve 40 is closed, a flitch can be placed against the cell plate 24 and the valves 40 then opened to apply vacuum to the vacuum cell areas 26 to retain the flitch in position. A conventional proximity sensor can be employed in combination with a control means to open the vacuum valves 40 when the flitch is positioned against the cell plate 24. To open the valves 40, pressure is applied to the aperture 70*b* to force the piston 74 to the right and align the reduced diameter portion 76 with the vacuum inlet and outlet 46, 48 to pass vacuum to the vacuum cell areas 26. In the open position, any dirt, splinters, or other debris carried by the flitch will be carried through the reduced diameter portion and out of the valve. One or more filters 88 can be disposed in the vacuum paths between the valves 40 and the vacuum source 34 to trap the debris. The one or more filters 88 can be located conveniently for removal and cleaning. If any debris should get caught in the valve 40 at the vacuum inlet or outlet 46, 48, the annular knife edge 84 will cut the debris at the cylindrical sidewall 44. Any debris cut during the closing movement of the valve 40 will remain in the reduced diameter portion 76 until the valve 40 is reopened. When the valve 40 opens again, the debris left in the reduced diameter portion 76 will be drawn out by the vacuum source 34.

Although fluid pressure is the preferred operating means, it will be appreciated that the valve may be manually or machine operated by using a push/pull rod or the like attached to one end of the piston 74. The push/pull rod may be connected by an arm to a bar that moves the push/pull rod as the bar moves in translation or rotation. Of course, a plurality of valves can be ganged together to the bar to be actuated simultaneously.

Although the invention has been described in detail with reference to a particular preferred embodiment, variations and modifications exist within the scope and spirit of the invention as described and defined in the following claims.

I claim:

1. A vacuum flitch table with a self-cleaning vacuum system, comprising:

a flitch table with a plurality of vacuum cells for retention of a flitch, a vacuum source connected with said plurality of vacuum cells, a plurality of self-cleaning vacuum valves, each valve comprising, a cylindrical valve body including a vacuum inlet and a vacuum outlet;

a piston disposed within the valve body for longitudinal movement between an open position and a closed position, the piston including port means for connecting the vacuum inlet and vacuum outlet when the piston is in the open position;

actuating means coupled to the piston for moving the piston between the open and closed positions; and a debris cutting means coupled to the piston.

2. The vacuum flitch table of claim 1 wherein each said piston includes a reduced diameter portion to accept said debris.

3. The vacuum flitch table of claim 1 wherein each valve further includes an end plug coupled to each end of the valve body, the end plugs and the valve body cooperating to define an interior region.

4. The vacuum flitch table of claim 3 wherein each said end plugs includes an aperture for providing fluid communication between the actuating means and the piston.

5. The vacuum flitch table of claim 4 wherein each said actuating means includes a fluid pressure source coupled to at least one aperture for moving the piston between open and closed positions.

6. The vacuum flitch table of claim 1 wherein each valve further includes an inlet adapter coupled to the vacuum inlet and an outlet adapter attached to the vacuum outlet.

7. The vacuum flitch table of claim 2 wherein each said debris cutting means comprises a sharp edge adjacent the reduced diameter portion.

8. The vacuum flitch table of claim 7 wherein each said sharp edge comprises an annular knife edge oriented to provide a cutting stroke during movement of the piston from the open position to the closed position for facilitating removal of debris caught in the vacuum valve.

9. The vacuum flitch table of claim 8 wherein each said annular knife edge includes a serrated edge.

10. The vacuum flitch table of claim 7 wherein each said sharp edge is positioned to cooperate with the cylindrical valve body at the vacuum inlet and vacuum outlet in a scissors action to cut debris extending through the vacuum inlet or the vacuum outlet.

11. In combination with a vacuum flitch table, a self-cleaning vacuum valve comprising:

a valve body including a cylindrical sidewall having a vacuum inlet, coupled to a vacuum source, and a vacuum outlet;

a piston disposed within the valve body and providing a vacuum port extending between the vacuum inlet and the vacuum outlet; and means for cooperating with the vacuum source to remove material from the vacuum valve.

12. The valve of claim 11 wherein the vacuum port includes a reduced diameter portion of the piston.

13. The valve of claim 12 wherein the cooperating means includes a sharp edge coupled to the piston and disposed to cut material extending into the valve body.

14. The valve of claim 13 wherein the sharp edge includes an annular knife edge that extends circumferentially around the piston and projects into the reduced diameter portion.

15. The valve of claim 11 wherein the cooperating means includes an annular knife edge configured for movement adjacent the cylindrical sidewall to remove material by cooperating with the cylindrical sidewall.

16. A vacuum valve comprising:

a valve body with a vacuum inlet and a vacuum outlet;

vacuum port means for selectively providing a vacuum path extending between the vacuum inlet and the vacuum outlet; and means, coupled to the vacuum port means, for facilitating removal of debris caught in the valve body.

17. The valve of claim 16 wherein the vacuum port means includes a piston disposed in the valve body and including a reduced diameter portion for providing a vacuum passage between the vacuum inlet and the vacuum outlet.

18. The valve of claim 16 wherein the facilitating means includes an annular knife edge movable within the valve body, the annular knife edge cooperating with the valve body to provide a scissors action to cut debris caught in the valve body.

19. The valve of claim 17 wherein the knife edge is coupled to the piston adjacent the reduced diameter portion.

* * * * *